United States Patent [19]

Rotman

[11] 3,977,593

[45] Aug. 31, 1976

[54] CARTON WITH DOUBLE, WALL AND BOTTOM

[75] Inventor: Lee Rotman, Cleveland, Ohio

[73] Assignee: The A. L. Garber Co., Cleveland, Ohio

[22] Filed: Oct. 14, 1975

[21] Appl. No.: 621,957

[52] U.S. Cl. ..... 229/38; 229/16 A

[51] Int. Cl.[2] ..... B65D 5/08

[58] Field of Search ..... 229/38, 16 A

[56] References Cited

UNITED STATES PATENTS

| | | | |
|---|---|---|---|
| 524,078 | 8/1894 | Walker | 229/38 |
| 1,442,837 | 1/1923 | Weber | 229/38 |
| 2,523,251 | 9/1950 | Pantalome et al. | 229/16 A |
| 2,673,679 | 3/1954 | LaBombard | 229/38 |
| 3,000,547 | 9/1961 | Foule et al. | 229/38 |
| 3,039,673 | 6/1962 | Modica | 229/38 |
| 3,638,853 | 2/1972 | Perry | 229/38 |

FOREIGN PATENTS OR APPLICATIONS

| | | | |
|---|---|---|---|
| 517,152 | 2/1931 | Germany | 229/38 |

*Primary Examiner*—Davis T. Moorhead
*Attorney, Agent, or Firm*—Axel H. Johnson

[57] ABSTRACT

A carton of fiberboard or the like formed from a unitary blank and having a double front wall and a double bottom. The conventional bottom extends forwardly and terminates in the double front wall, and the additional bottom extends rearwardly and includes a tuck portion to be inserted between the conventional bottom and the usual bottom flaps.

3 Claims, 6 Drawing Figures

CARTON WITH DOUBLE, WALL AND BOTTOM

BACKGROUND OF THE INVENTION.

1. Field of the Invention.

This invention concerns a carton having a double front wall and a double bottom panel to provide additional rigidity against collapse, permitting the carton to be used for storing heavy objects.

2. Description of the Prior Art.

The prior art embraces cartons in general, having single walls and panels.

SUMMARY OF THE INVENTION.

An object of this invention is to provide a carton capable of resisting collapse when stored with other cartons or handled carelessly. The object is accomplished by providing a double bottom and a double vertical front wall. The double front wall resists compression under load and the double bottom panel provides a rigid bottom that resists distortion under load, and also assures that small articles stored therein will not escape through openings frequently present in conventional folded cartons.

Referring to the drawings.

Figure 1:
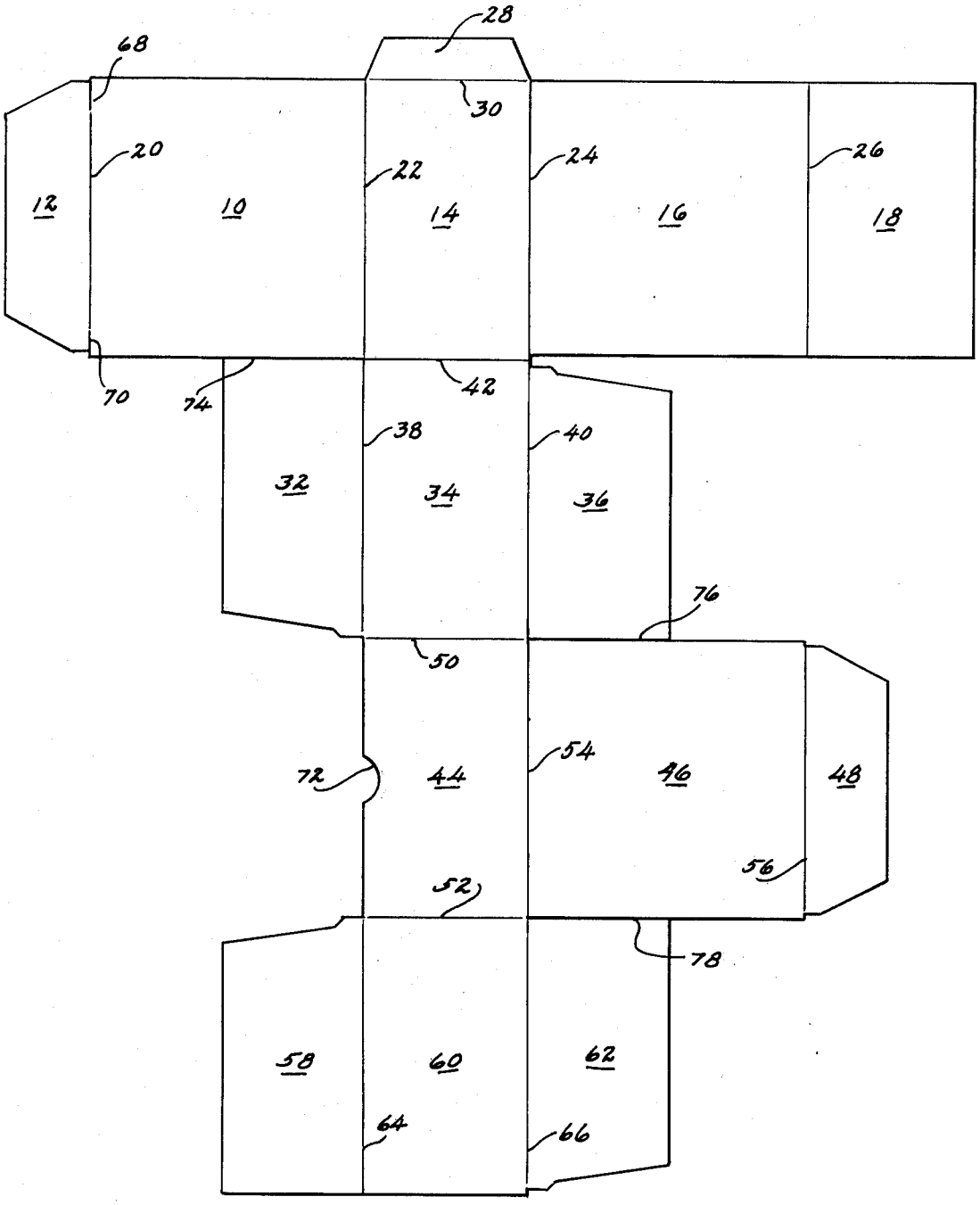
FIG. 1 shows the inner surface of the unitary blank of the carton of this invention.

Referring again to the drawings; the unitary blank of FIG. 1 comprises a top panel 10, a tuck portion 12, a back wall 14 an inner bottom panel 16 and a inner vertical front wall 18 defined by folds 20, 22, 24 and 26. A glue flap 28 is defined by a fold 30. A Left upper dust flap 32, Left side wall 34 and lower Left dust flap 36 are defined by folds 38, 40 and 42. Front wall 44, outer bottom panel 46 and tuck portion 48 are defined by folds 50, 52, 54 and 56. Right upper dust flap 58, Right side wall 60 and Right lower dust flap 62 are defined by folds 64 and 66. Slit locks 68 and 70 are provided to assist in maintaining the top 10 in a closed position. A thumb notch 72 is provided in the front wall 44 for convenience in opening top panel 10. Slit 74 separates panel 10 from flap 32. Slit 76 separates flap 36 from panel 46, and slit 78 separates panel 46 from flap 62.

The customary means of facilitating the forming of the carton from the blank is by providing "score lines" on the surface opposed to that shown in FIG. 1, or the exterior surface, indicated as 20, 22, 24, 26, etc. The various walls and panels can then be hinged to form the finished carton.

Figure 2:
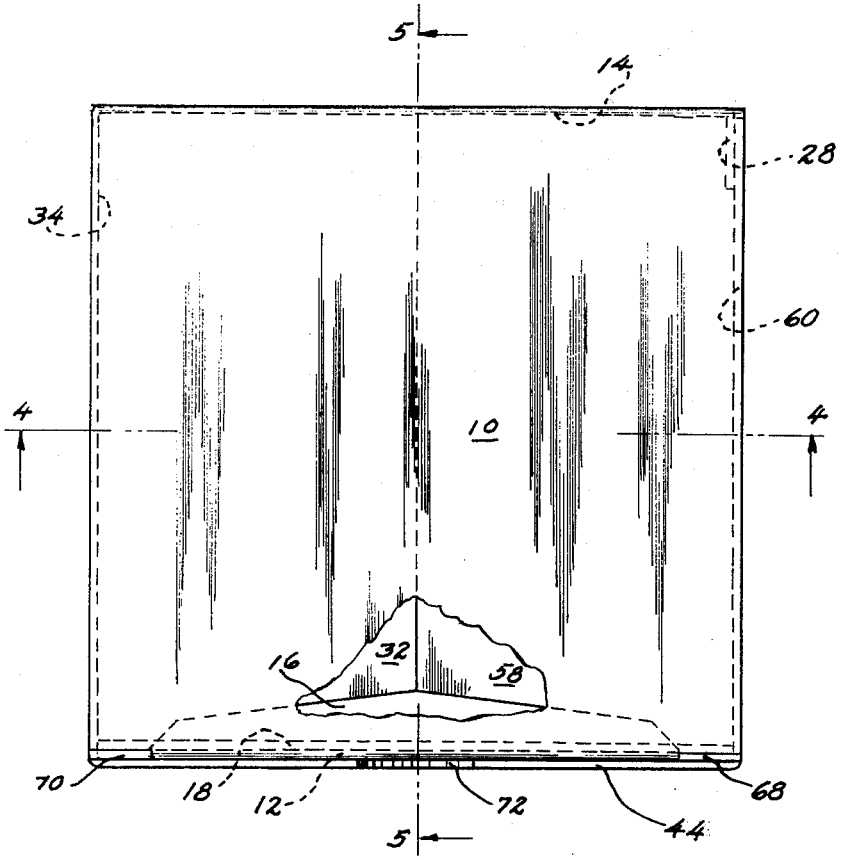
FIG. 2 is a top view of the assembled carton with parts broken away to expose details.
Figure 3:
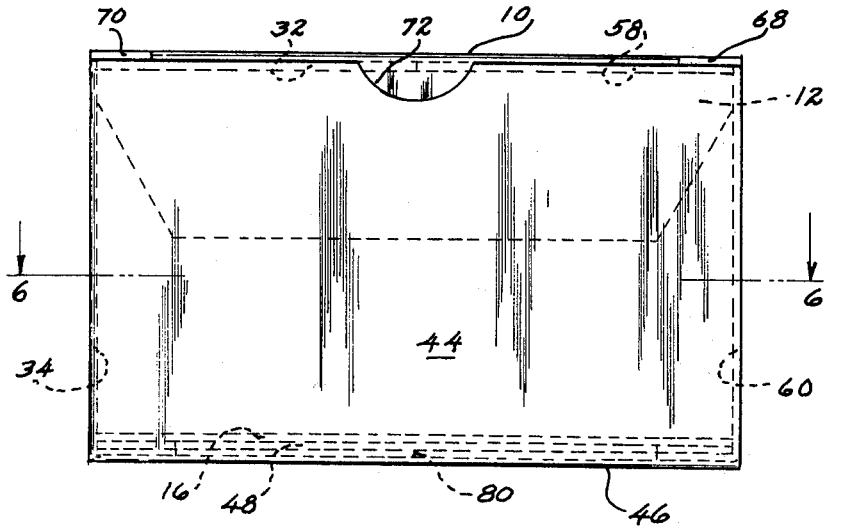
FIG. 3 is an upright view of the front of the carton.
Figure 4:
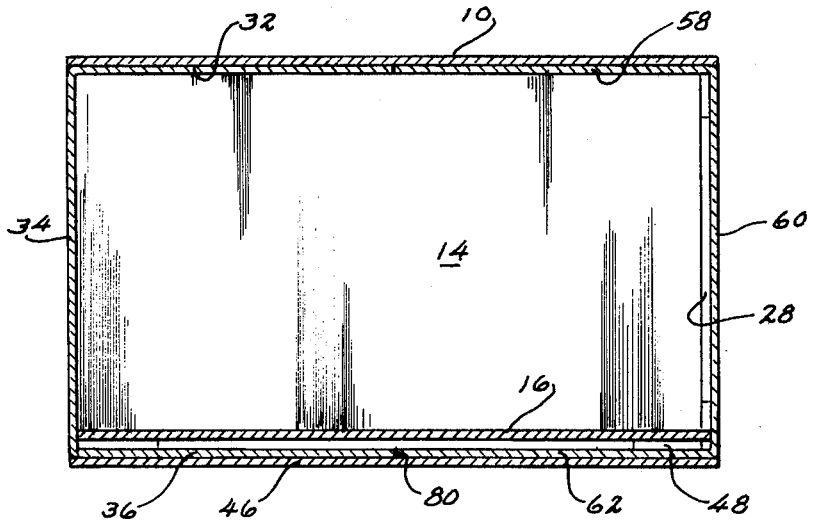
FIG. 4 is a section taken at 4—4 of FIG. 2.
Figure 5:
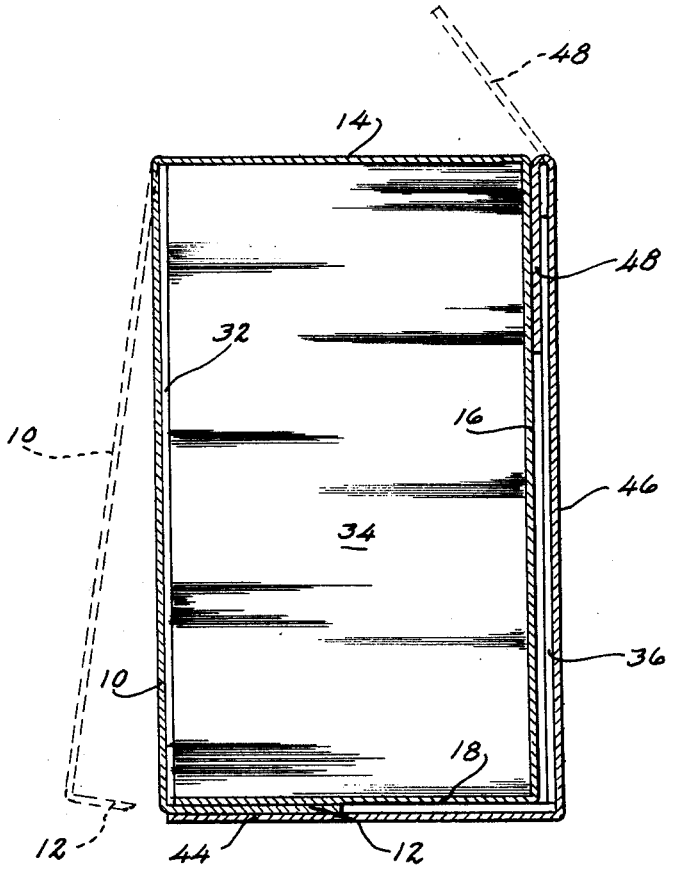
FIG. 5 is a section taken at 5—5 of FIG. 2.
Figure 6:
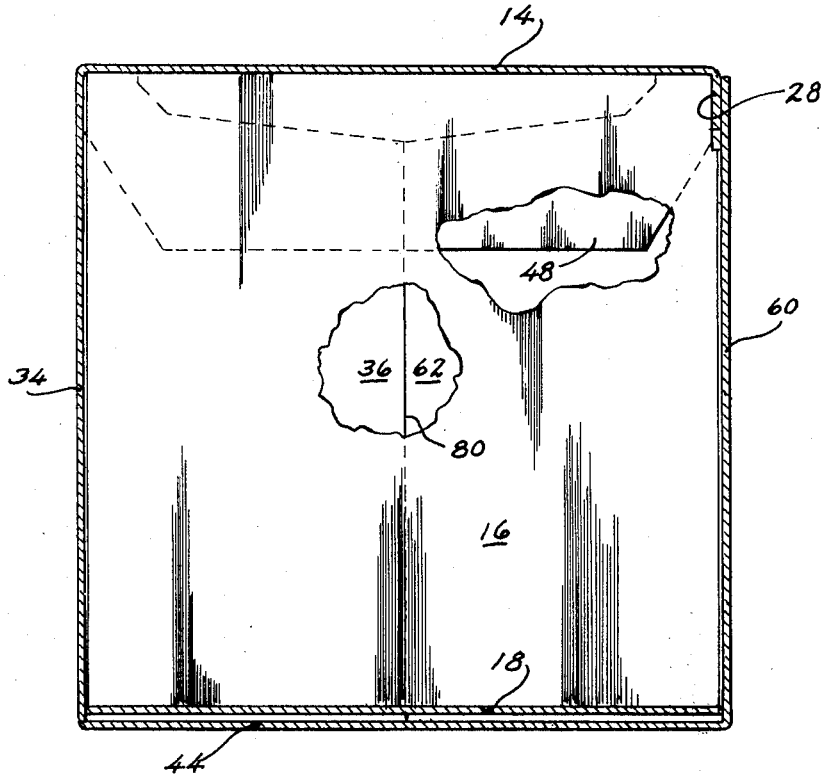
FIG. 6 is a section taken at 6—6 of FIG. 3.

All panels and walls, as shown in FIG. 1 are folded upwardly; the proper order of folding being as follows: Walls 60, 44 and 34 are hinged so that wall 60 can be glued outwardly to flap 28, thereby forming a rectangle as in FIG. 6. Inner bottom panel 16 is then folded forwardly with front wall 18 thereof extending upwardly and inwardly adjacent front wall 44 as shown in FIGS. 5 and 6. Dust flaps 36 and 62 are then folded mutually inwardly to meet as shown at 80 of FIGS. 3, 4 and 6. Bottom panel 46 is then directed rearwardly beneath dust flaps 36 and 62, and in contact with the lower surface of the dust flaps. The next operation in assembling the carton is to then flex the tuck portion 48 as also shown in dotted lines in FIG. 5, before being tucked in. The tuck portion 48 is then inserted forwardly between the inner bottom panel 16 and dust flaps 36 and 62. Finally, when closing the carton top panel 10 is folded forwardly with tuck portion 12 inserted downwardly intermediate front wall 44 and inner wall 18, as shown in FIGS. 2, 3 and 5.

It is within the purview of the invention that the blank shown in FIG. 1 can be comprised of a plurality of separate segments if convenience in production so dictates.

The above being a complete description of an illustrative embodiment of the invention, what is claimed as new and desired to be secured by Letters Patent of the United States is:

1. A carton produced from a blank, said carton having Left and Right spaced upright side walls and rear and front spaced upright walls, said walls forming an upright enclosure, each of said upright side walls having upper and lower dust flaps integral therewith and directed mutually inwardly of said enclosure and defining planes substantially normal to said walls, an inner bottom panel integral with the lower edge of said rear upright wall and extending forwardly above said lower dust flaps and toward said front wall to terminate in an inner front wall directed upwardly adjacent to the inner face of said front wall, an outer bottom panel integral with the lower edge of said front upright wall and extending rearwardly below said lower dust flaps and terminating in a tuck portion, said tuck portion inserted forwardly intermediate said inner bottom panel and said lower dust flaps.

2. A carton as set forth in claim 1, in which said rear upright wall terminates at the Right vertical edge thereof in a glue flap, and the free edge of said Right side wall being adhesively secured thereto.

3. A carton as set forth in claim 1, having a top panel integral with the upper edge of said rear upright wall, said top panel directed forwardly to terminate in a tuck portion, said tuck portion inserted downwardly intermediate said front wall and said inner wall to close said carton.

* * * * *